United States Patent [19]

Yerly

[11] 4,015,495

[45] Apr. 5, 1977

[54] DEVICE FOR STRIPPING WASTE FROM A SHEET DIE CUT ON A PLATEN PRESS

[75] Inventor: Marcel Yerly, Renens, Switzerland

[73] Assignee: J. Bobst & Fils S.A., Switzerland

[22] Filed: Feb. 14, 1975

[21] Appl. No.: 549,972

[30] Foreign Application Priority Data

Mar. 7, 1974 Switzerland ..... 003251/74

[52] U.S. Cl. ..... 83/103; 93/36 A; 225/97; 83/145

[51] Int. Cl.[2] ..... B26D 7/06; B31B 1/00

[58] Field of Search ..... 83/103, 145; 93/36 A; 225/97

[56] References Cited

UNITED STATES PATENTS

| | | | |
|---|---|---|---|
| 3,055,275 | 9/1962 | Schroter | 225/97 X |
| 3,060,776 | 10/1962 | Bobst et al. | 93/36.A X |
| 3,784,070 | 1/1974 | Vossen | 93/36 A X |

*Primary Examiner*—Othell M. Simpson
*Assistant Examiner*—W. D. Bray
*Attorney, Agent, or Firm*—Hill, Gross, Simpson, Van Santen, Steadman, Chiara & Simpson

[57] ABSTRACT

A device designed for stripping waste from a sheet, which has been die cut by means of a platen press. The device includes two lateral frames, a fixed upper part or plate in which stripping tools are fixed, a lower movable supporting plate with apertures, which have the outline corresponding to the outlines of the waste to be removed, means for conveying a sheet between the upper and lower plates which means consist of gripper bars fitted between two endless chains running within the lateral frame members, and means for raising a portion of the means for conveying during the movement of the lower movable supporting plate.

11 Claims, 4 Drawing Figures

DEVICE FOR STRIPPING WASTE FROM A SHEET DIE CUT ON A PLATEN PRESS

BACKGROUND OF THE INVENTION

1. Field of the Invention

The invention pertains to sheet fed platen presses incorporating a stripping station for stripping waste from a die cut sheet wherein sheets are individually transported by gripper bars supported by endless chains or their equivalent to the stripping station and the stripping is effected by relative movement between a templet having perforations corresponding to the waste to be stripped from the die cut sheet and a support having stripping fingers connected thereto which engage the waste and force it through the perforations in the templet.

2. Prior Art

In stripping devices which have heretofore been used in sheet fed platen presses and which includes a fixed upper part and a movable lower perforated plate or part, the die cut sheet as well as the means of conveyance or means for conveying the sheet (usually chains) carry out a vertical upward and downward movement during the stripping operation. The fixed upper part of such a stripping device includes stripping tools arranged opposite the apertures of the perforated plate. The apertures of the perforated plate have outlines which correspond generally to the outlines of the waste to be stripped from the sheet. Hence, when the vertical motion of the movable lower part takes place the lower part raises the sheet, and the waste will enter into contact with the stripping tools and drop from the sheet while the sheet continues its vertical motion with the lower plate or part. Then, the movable lower part will take up its starting or lower position so that the sheet, now stripped of waste, can be withdrawn from this stripping station by means of the conveying chains. During the whole stripping operation, the sheet is held in position by a gripper bar connected to the means of conveyance which gripper bar and means of conveyance have also undergone an upward motion. However, the lifting of the means of conveyance, once they have come to a resting position during a dwell period of advancement occurs when the frame of the movable lower part enters into contact with the means of conveyance resulting in a rather strong hit or blow to the means of conveyance which blow or hit raises the operating sound level of the machine and interferes with the stripping operation by causing vibrations. This striking of the chains when they are in their rest positions also occurs upon return motion of the movable lower part of the stripping station to its starting position due to the fact that the conveyance chains drop onto their respective chain guides with a rather sharp blow. Moreover, these repeated blows are harmful for the mechanical service life of the means of conveyance and their associated parts particularly in view of the fact that on present day platen presses the stripping operation may be repeated as frequently as 6500 times per hour.

SUMMARY OF THE INVENTION

A stripping device constructed in accordance with the principles of the present invention has been designed to eliminate the strong hits involved with the present day systems and to thereby increase the machine operating speed without interferring with the stripping operation while also increasing the service life of the mechanical parts of which the stripping station consists. The invention is characterized by providing means for moving or raising the sheet conveying means separate to a lifting force applied by the lower plate or part. The means for moving or raising includes a portion of the chain guides which have one end mounted for pivotable movement on the side frame member. To pivot the guide means, a linkage is attached adjacent the opposite end and is connected to one arm of a two arm lever which is mounted for rotation and has a second arm with a roller disposed in a slot provided in the lower movable part so that upward movement of the lower part causes the opposite end of the chain guides to lift the gripper bar and adjacent portion of the chains.

More simply, means are provided for lifting the chain guide rails as the lower movable part of the stripping station moves upwardly thereby practically eliminating the abrupt contact between a moving part and a resting chain.

DESCRIPTION OF THE PREFERRED EMBODIMENT

Figure 1:
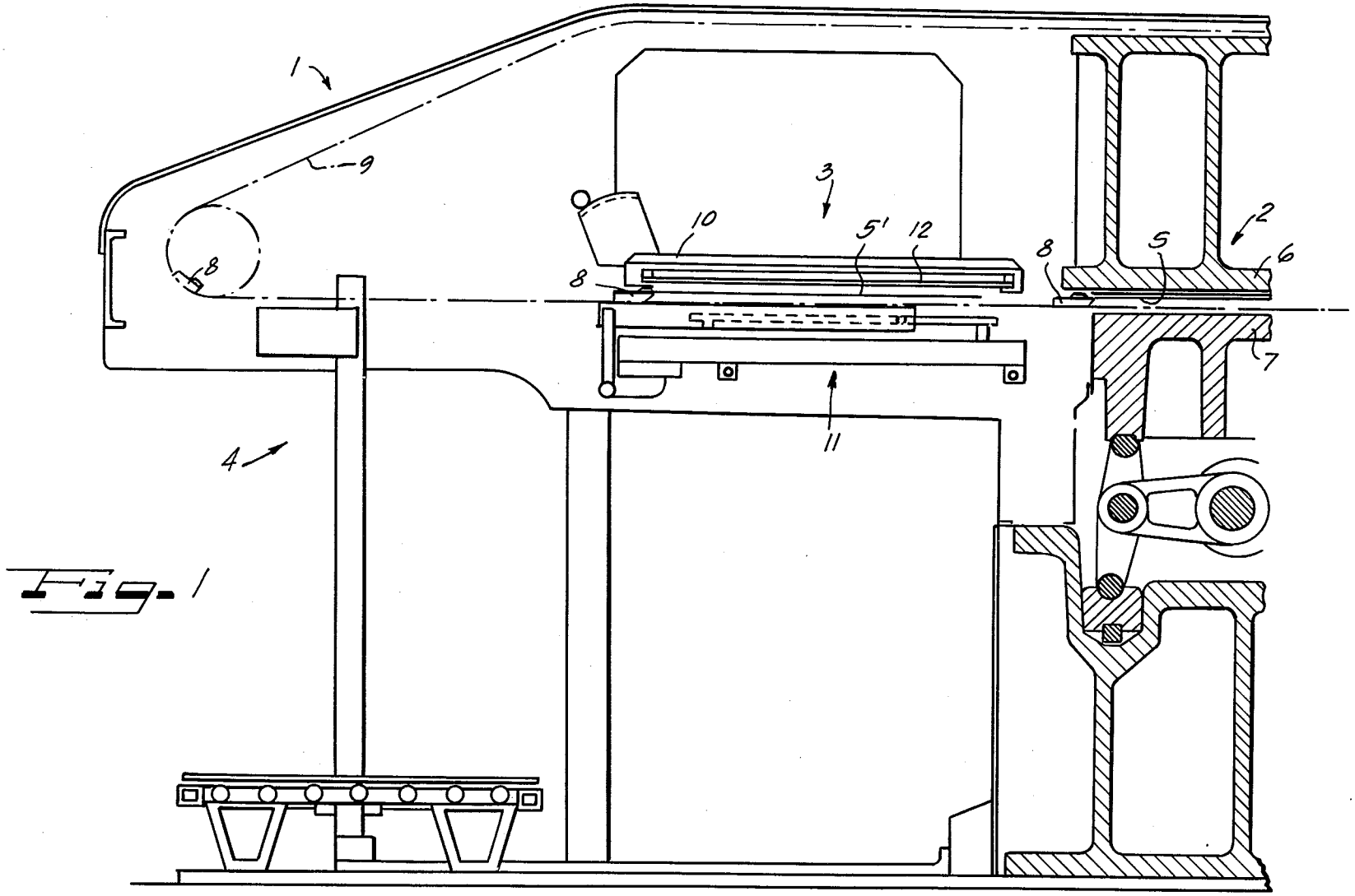
FIG. 1 is a partial view of a platen press showing some parts in side elevation and some in vertical section.

FIG. 1 is a partial view of a platen press 1 including a die-cutting station 2 followed by a stripping station 3 and a delivery station 4. Sheet 5 shown in this case between the platens 6 and 7 of the die-cutting station 2 is subsequently moved into the position of sheet 5' within the stripping station 3 by means of the gripper bars 8 each of which is carried at its ends by endless chains 9 and 9' (see FIG. 4). Stripping station 3 consists of a fixed upper part 10 and a movable lower part 11, the latter moving up and down. The fixed upper part 10 includes a plate 12 in which stripping tools 13 have been fitted (see FIG. 2 and 3).

Figure 2:
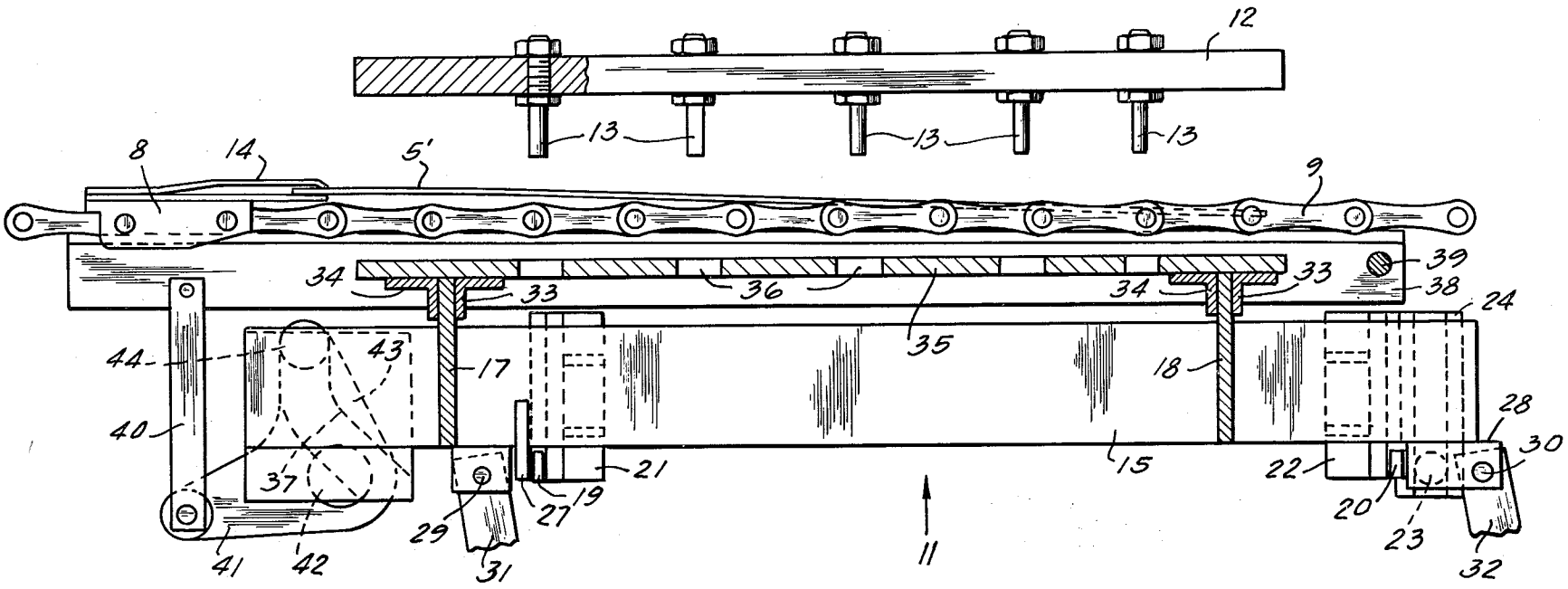
FIG. 2 is a fragmentary view of a portion of the stripping station showing the movable lower part in its lower position.
Figure 3:
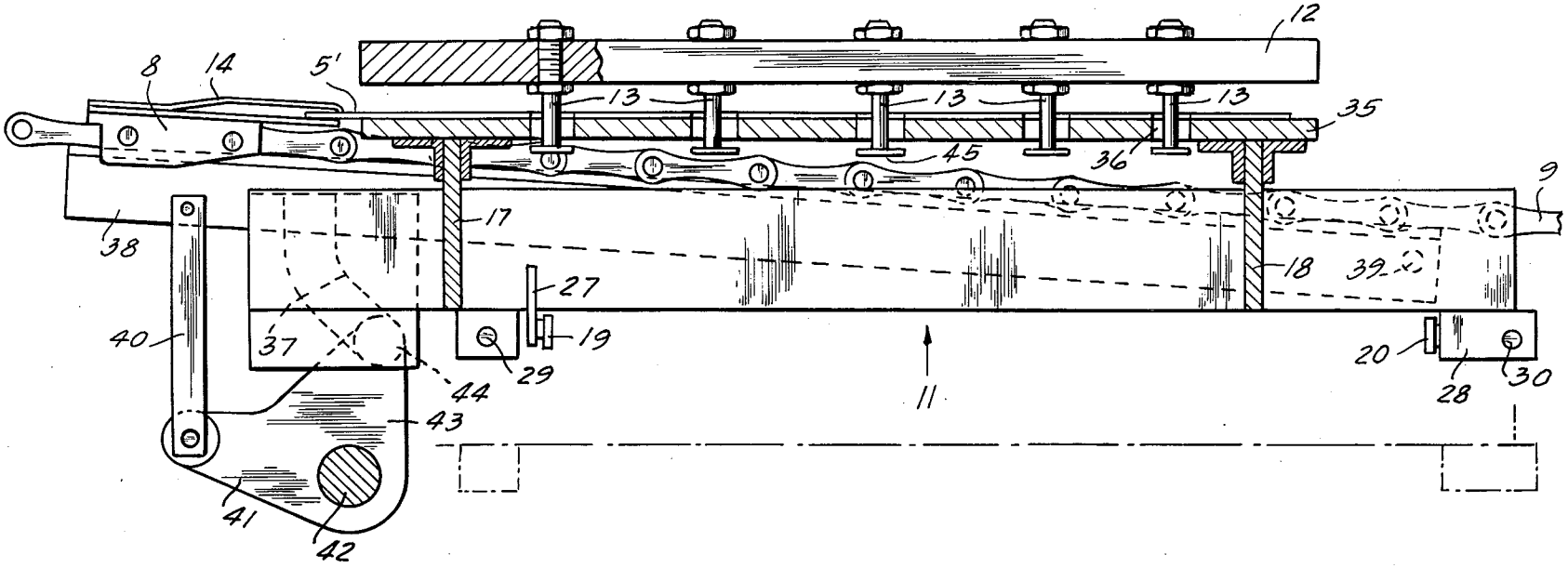
FIG. 3 is a fragmentary view of the stripping station which is substantially identical to FIG. 2 but for the fact that the movable lower part of the stripping station is shown in its upper position.
Figure 4:
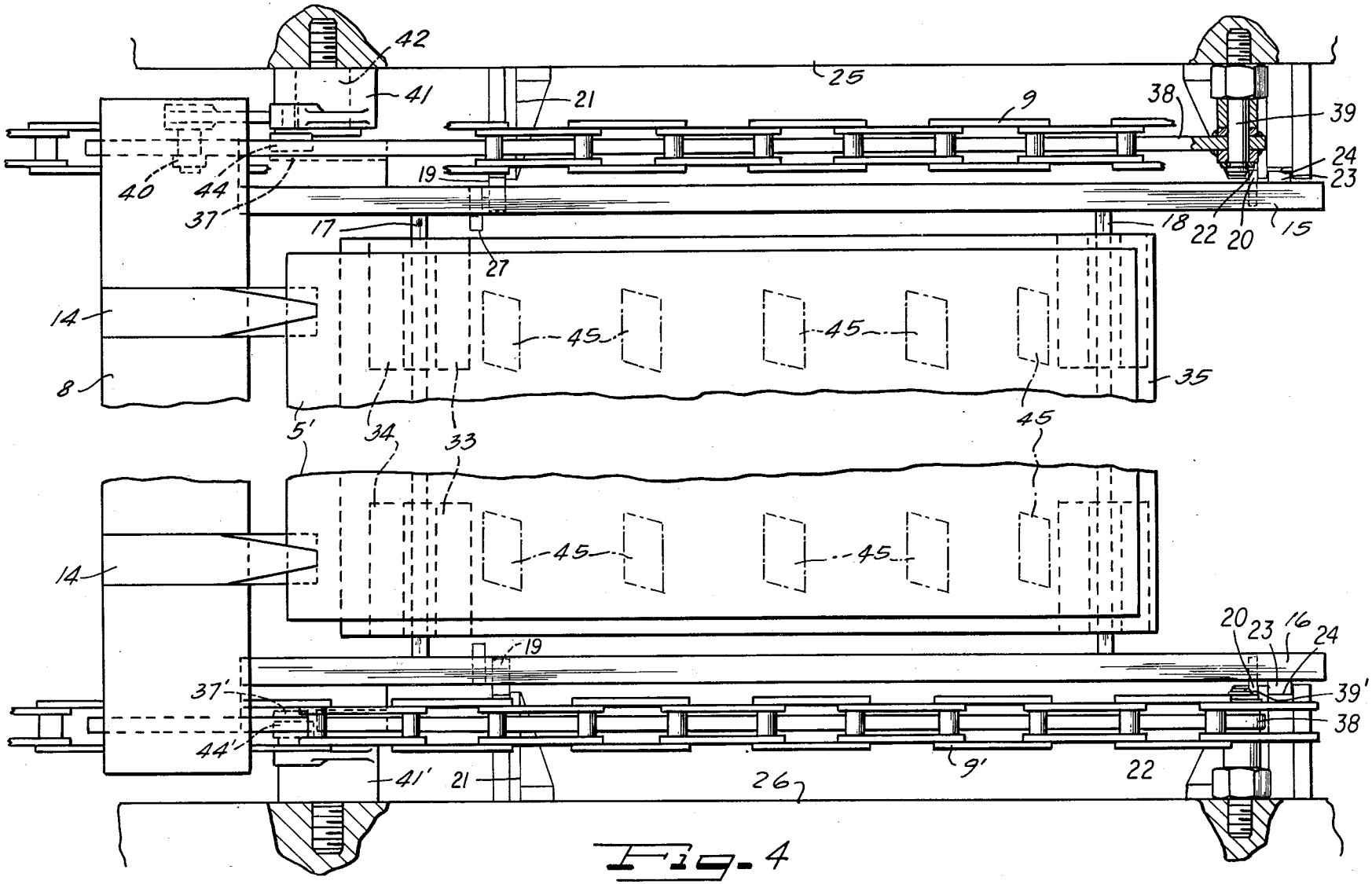
FIG. 4 is a plan view of various parts of the stripping station equipped with the novel features of the present invention.

FIG. 2 is a view showing the lower part 11 in its lower position, i.e. in the position it takes up when the sheet 5' held by the grippers 14 on the bar 8 comes to a standstill within the stripping station 3 during a dwell period of the conveying means. The lower part 11 consists of a right-hand longitudinal beam 15 and a left-hand longitudinal beam 16 (see FIG. 4) connected to one another by means of cross-bars 17 and 18 to form a frame. To ensure the lateral guiding of the lower part during vertical movement, the beam 15 has two rollers 19 and 20 rolling within the guide rails 21 and 22 (see FIG. 2). Another roller 23 received in a guide rail 24 ensures the lengthwise positioning of the lower part. The roller 19 is mounted on the beam 15 by a support 27 and the rollers 20 and 23 are mounted on the beam by a common support 28. The guide rails 21, 22 and 24 are mounted on the lateral right hand frame 25 of the stripping station 3. The left hand longitudinal beam 16 also is provided with rollers such as 19, 20 and 23 (not illustrated) which move within guide rails similar to the rails 21, 22 and 24 which rails are mounted on the left hand side frame member 26. The control for the vertical motion of the lower part 11 acts on pivots 29 and 30 through the pull rods 31 and 32 which are part of a conventional lifting device for a stripping station. The cross-bars 17 and 18 hold plate 35 by means of the corner pieces 33 and 34. The plate 35 has been provided with an aperture 36, the outline of which corresponds to the one of the sheet part to be stripped. This plate 35 moves hence simultaneously with the lower part 11. A slot 37, which provides a camming surface, is provided at the end of the longitudinal beam 15. The chain guides 38 and 38' are mounted for pivotable movement on axles 39 and 39' which are threaded in frame members25 and 26, respectively, and the guides or rails 38 and 38' support the chains 9 and 9' within the stripping station 3. These chain guides 38 and 38' turn around the axles 39 and 39' under the control of a pull rod 40 connected to lever 41. Lever 41 is fitted on an axle 42 which is threadably mounted on the right-hand side frame 25 of the stripping station 3. The arm 43 of the lever 41 is equipped with a cam follower 44, which follows the surface of slot 37 when the vertical movement of the lower part 11 takes place. The left-hand longitudinal beams 16 (see FIG. 4) fitted in a parallel position with regard to the longitudinal beam 15 is also equipped with a slot 37 in which will move the follower 44' of the lever 41' which latter pivots around an axle 42 mounted on the left-hand side frame 26 of the stripping station 3. As illustrated in FIGS. 2 and 3, the slot 37 has a vertical portion and an inclined portion. When the follower such as 44 moves in the vertical portion, no rotational movement is applied to the lever 41 and during movement in the inclined portion, rotation is applied to the lever 41. Therefore, initial movement of the follower in the vertical portion provides a lost motion connection or linkage in the linkage between the lower part 11 and the chain guides 38 and 38'.

FIG. 3 illustrates the lower part 11 in its upper position, i.e. the position it takes at the end of the waste stripping operation. The lower part 11 having been moved upwards from its lower position as represented with dot-dash lines, the plate 35 will come into contact with the sheet 5', and the roller 44 will have followed the slot 37 in its straight upper part. From this moment onwards, with the sheet 5' still being held by the grippers 14, it will become necessary to raise the gripper bar 8 and the lower part 11 together. To this aim, a chain tension slackener (not shown) is actuated, whereas the cam follower 44 moving in the inclined portion of slot 37 causes the lever 41 to pivot around the axle 42. The lever 41 being connected to the chain guide 38 by means of the pull rod 40 causes the chain guide 38 to turn around the axle 39, the consequence of which will be that the gripper bar 8 is raised so that it will accompany the sheet 5' along its movement. The chain guides 38 and 38' still being in contact with the chains, it is obvious that no blow will occur when the gripper bar is raised. During the rise of the lower part 11, the stripping tools 13 will push the waste 45 downwards through the apertures 36 of the plate 35. At this moment, the lower part 11 will descend again and take up its initial position (see FIG. 2), whereas the sheet 5' stripped from its waste 45 will be withdrawn from the stripping station 3, owing to a new movement of the chains 9 and 9'.

It will be understood that this embodiment of the invention has been used for illustrative purposes only and that various modifications and variations of the invention may be made without departing from the spirit and scope of the novel concepts thereof.

I claim:

1. A platen press including a station having a vertically movable lower part, a cooperating upper part, conveying chains adjacent opposed side edges of said upper and lower parts, a gripper bar supported at its ends by said chains and having means for holding a sheet in a position between said parts, chain support guides underlying each of said chains and supporting said chains in said press, each of said chain support guides having ends and means for moving at least one end of each of said chain support guides toward and away from said upper part as said movable lower part moves toward and away from said upper part.

2. A platen press constructed in accordance with claim 1, wherein each of said chain support guides has one end pivotally mounted in said platen press adjacent the feed side of said upper and lower parts and wherein said means for moving acts on the opposite ends of said chain support guides to pivot them about said one end.

3. A platen press constructed in accordance with claim 1, wherein said means for moving includes a lost motion link interconnecting each of said chain support guides and said movable lower part and wherein said chain support guides are moved upwardly after at least a portion of the vertical upward stroke of said movable lower part has been completed.

4. A platen press constructed in accordance with claim 1, wherein said means for moving includes at least one cam surface on said movable lower part, a lever pivotally mounted in said station, about a fixed pivot and having a follower riding along said cam surface, said lever having an arm linked to said chain support guides to effect upward movement of said chain support guides during vertical upward movements of said movable lower part.

5. In a waste stripping assembly for stripping waste from a die cut sheet, said assembly including a pair of side frames, a fixed upper part having a plate and having stripping tools carried on said plate, a movable lower part carrying a plate with apertures corresponding to the outlines of the waste and movable in the direction of said upper part, sheet conveying means movable intermittently between said plates and having gripper means to pull a sheet to be stripped into the space between said plates, the improvement comprising separate means mounted in said side frames engaging said sheet conveying means and moving said sheet conveying means in the direction of said upper part during movement of said lower part toward said upper part.

6. In a waste stripping assembly constructed in accordance with claim 5, wherein the said conveying means comprise a pair of endless chains with at least one gripper bar extending therebetween and fixed to the chains, the improvement further comprising said separate means raising the gripper bar and the adjacent portions of the interconnected chains relative to said upper part in the same relative directions and during the same periods that said lower part moves relative to said upper part.

7. In a waste stripping assembly constructed in accordance with claim 5, wherein said means for moving moves said sheet conveying means away from said upper part during movement of said lower part away from said upper part.

8. A waste stripping assembly for stripping waste from a die cut sheet comprising a pair of side frames, an upper part fixed to said side frames and having stripping tools extending downwardly therefrom, a movable lower part having means defining apertures corresponding to the outlines of the waste to be stripped from the sheet, said stripping tools being positioned in relative congruence to said apertures, means moving said lower part toward and away from said fixed upper part in order to cause waste to be stripped from a sheet positioned therebetween and forced through said apertures, a pair of intermittently movable endless chains carried on said side frames, at least one gripper bar extending between said chains and connected therewith and having gripping fingers positioned thereon to grip a sheet and move it into position between said upper and lower parts, a guide rail underlying each of said chains in the area adjacent said parts and providing support for said chains, and means raising each of said guide rails having ends and lowering said guide rails as said lower part is raised and lowered relative to said fixed upper part.

9. A waste stripping assembly constructed in accordance with claim 8, wherein said means for raising and lowering said guide rails comprises a lost motion connection between said guide rails and said movable lower part.

10. A waste stripping assembly constructed in accordance with claim 8, wherein one end of each of said guide rails is pivotally connected to said side frame and wherein said means for raising and lowering said guide rails comprise a cam surface formed on said movable lower part, a double lever arm pivotally mounted on said side frame, one arm of said double lever arm carrying a cam follower which rides on said cam surface, the other arm of said double lever arm being pivotally interconnected to a link, said link being pivotally interconnected with an end of the guide rail opposite the one end thereof.

11. A waste stripping assembly constructed in accordance with claim 10, wherein said cam surface is formed by a slot which is partially vertical and partially inclined.

* * * * *